US006868695B1

(12) United States Patent
Dingel et al.

(10) Patent No.: US 6,868,695 B1
(45) Date of Patent: Mar. 22, 2005

(54) FLOW DISTRIBUTOR AND BAFFLE SYSTEM FOR A FALLING FILM EVAPORATOR

(75) Inventors: Benjamin E. Dingel, La Crosse, WI (US); James W. Larson, La Crosse, WI (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 10/824,287

(22) Filed: Apr. 13, 2004

(51) Int. Cl.[7] ..... F25B 39/02
(52) U.S. Cl. ..... 62/515; 165/115
(58) Field of Search ..... 62/515, 525; 165/115, 165/116, 117, 118

(56) References Cited

U.S. PATENT DOCUMENTS

| | | | | |
|---|---|---|---|---|
| 3,831,390 A | * | 8/1974 | Hopkins | 62/101 |
| 5,561,987 A | * | 10/1996 | Hartfield et al. | 62/471 |
| 5,575,889 A | * | 11/1996 | Rosenblad | 159/49 |
| 5,588,596 A | * | 12/1996 | Hartfield et al. | 165/117 |
| 5,645,124 A | * | 7/1997 | Hartfield et al. | 165/117 |
| 5,809,794 A | * | 9/1998 | Sibik et al. | 62/204 |
| 5,839,294 A | * | 11/1998 | Chiang et al. | 62/471 |
| 6,035,651 A | * | 3/2000 | Carey | 62/115 |
| 6,233,967 B1 | * | 5/2001 | Seewald et al. | 62/470 |
| 6,293,112 B1 | * | 9/2001 | Moeykens et al. | 62/84 |
| 6,357,239 B2 | * | 3/2002 | Carey | 62/84 |
| 6,516,627 B2 | * | 2/2003 | Ring et al. | 62/471 |
| 6,532,763 B1 | * | 3/2003 | Gupte | 62/515 |

FOREIGN PATENT DOCUMENTS

| | | | |
|---|---|---|---|
| DE | 003327233 A1 | * | 2/1985 |
| EP | 0843139 A2 | * | 5/1988 |

* cited by examiner

*Primary Examiner*—William E. Tapolcai
*Assistant Examiner*—Mohammad M. Ali
(74) *Attorney, Agent, or Firm*—William J. Beres; William O'Driscoll

(57) ABSTRACT

A falling film evaporator includes a flow distributor for uniformly distributing a two-phase refrigerant mixture across a tube bundle. The flow distributor includes a stack of at least three perforated plates each of which are separated by nearly full-width, full-length gaps or chambers. The flow distributor may also include a suction baffle and/or a distributor baffle. The distributor baffle extends downward to provide a hairpin turn past which refrigerant travels before exiting the evaporator. This directional change helps separate liquid from a primarily gaseous refrigerant stream. The suction baffle has various size openings to ensure that the flow rate of refrigerant through the hairpin turn is generally uniform and is maintained low enough to ensure liquid disentrainment over and along the length of the tube bundle within the evaporator.

26 Claims, 4 Drawing Sheets

FLOW DISTRIBUTOR AND BAFFLE SYSTEM FOR A FALLING FILM EVAPORATOR

BACKGROUND OF THE INVENTION

1. Field of the Invention

The present invention relates to a falling film evaporator of a refrigerant system. More particularly, the present invention relates to a distributor and baffle system that directs the flow of a two-phase refrigerant mixture entering and vapor leaving the evaporator.

2. Description of Related Art

The primary components of a refrigeration chiller include a compressor, a condenser, an expansion device and an evaporator. Higher pressure refrigerant gas is delivered from the compressor to the condenser where the refrigerant gas is cooled and condensed to the liquid state. The condensed refrigerant passes from the condenser to and through the expansion device. Passage of the refrigerant through the expansion device causes a pressure drop therein and the further cooling thereof. As a result, the refrigerant delivered from the expansion device to the evaporator is a relatively cool, saturated two-phase mixture.

The two-phase refrigerant mixture delivered to the evaporator is brought into contact with a tube bundle disposed therein and through which a relatively warmer heat transfer medium, such as water, flows. That medium will have been warmed by heat exchange contact with the heat load which it is the purpose of the refrigeration chiller to cool. Heat exchange contact between the relatively cool refrigerant and the relatively warm heat transfer medium flowing through the tube bundle causes the refrigerant to vaporize and the heat transfer medium to be cooled. The now cooled medium is returned to the heat load to further cool the load while the heated and now vaporized refrigerant is directed out of the evaporator and is drawn into the compressor for recompression and delivery to the condenser in a continuous process.

More recently, environmental, efficiency and other similar issues and concerns have resulted in a need to re-think evaporator design in refrigeration chillers in view of making such evaporators more efficient from a heat exchange efficiency standpoint and in view of reducing the size of the refrigerant charge needed in such chillers. In that regard, environmental circumstances relating to ozone depletion and environmental warming have taken on significant importance in the past several years. Those issues and the ramifications thereof have driven both a need to reduce the amount and change the nature of the refrigerant used in refrigeration chillers.

So-called falling film evaporators, which are known in the industry, have for some time been identified as appropriate for use in refrigeration chillers to address efficiency, environmental and other issues and concerns in the nature of those referred to above. While the use and application of evaporators of a falling film design in refrigeration chillers is theoretically beneficial, their design, manufacture and incorporation into chiller systems has proven challenging, particularly with respect to the need to uniformly distribute refrigerant across the tube bundles therein. Uniform distribution of the refrigerant delivered into such evaporators in a refrigeration chiller application is critical to the efficient operation of both the evaporator and the chiller as a whole. Achieving the uniform distribution of refrigerant is also a determining factor in the success and efficiency of the process by which oil, which migrates into the evaporator, is returned to the chiller's compressor. The efficiency of the process by which oil is returned from a chiller's evaporator affects both the quantity of oil that must be available within the chiller and chiller efficiency. U.S. Pat. No. 5,761,914, assigned to the assignee of the present invention, may be referred to in that regard.

Exemplary of the current use of falling film evaporators in refrigeration chillers is the so-called RTHC chiller manufactured by the assignee of the present invention. In addition to the '914 patent referred to above, reference may be had to U.S. Pat. Nos. 5,645,124; 5,638,691 and 5,588,596, likewise assigned to the assignee of the present invention and all of which derive from a single U.S. patent application, for their description of early efforts as they relate to the design of falling film evaporators for use in refrigeration chillers and refrigerant distribution systems therefor. Reference may also be had to U.S. Pat. No. 5,561,987, likewise assigned to the assignee of the present invention, which similarly relates to a chiller and chiller system that makes use of a falling film evaporator.

In the RTHC chiller, the refrigerant delivered to the falling film evaporator is not a two-phase mixture but is in the liquid state only. As will be apparent to those skilled in the art, uniform distribution of liquid-only refrigerant is much more easily achieved than is distribution of a two-phase refrigerant mixture. The delivery of liquid-only refrigerant for distribution over the tube bundle in the falling film evaporator in the RTHC chiller, while making uniform refrigerant distribution easier to achieve, is achieved at the cost and expense of needing to incorporate a separate vapor-liquid separator component in the chiller upstream of the evaporator's refrigerant distributor. The separate vapor-liquid separator component in the RTHC chiller adds significant expense thereto, in the form of material and chiller fabrication costs, such vapor-liquid separator component being a so-called ASME pressure vessel, which is relatively expensive to fabricate and incorporate into a chiller system.

Recently developed chillers have flow distribution systems that can effectively direct the flow of a two-phase refrigerant mixture through a falling film evaporator. Examples of such chillers are disclosed in U.S. Pat. Nos. 6,167,713 and 6,293,112, which are assigned to the assignee of the present invention and are specifically incorporated by reference herein. To evenly distribute two-phase refrigerant across the full length and width of a tube bundle, the chillers of the '713 and '112 patents have a flow distributor that includes a diamond-shaped suction inlet duct that feeds a stack of perforated plates. One of the plates has a series of diamond-shaped passages that promotes lateral flow for even distribution of refrigerant over the width of the tube bundle. The inlet duct is also preferably a diamond-shape to evenly distribute the refrigerant along the length of the tube bundle. Although such a distributor is quite effective, it can be difficult and expensive to produce. Assembling and attaching the multiple plates can involve extensive processing in the form of welding or other joining operations and can add a significant amount of weight to the distributor.

In some cases, baffles are installed between the evaporator outlet and the area where the refrigerant is vaporized by the tube bundle. The baffles can help separate the liquid and gas components of the two-phase refrigerant mixture so that the portion of refrigerant returned to the suction side of the compressor is almost entirely gaseous refrigerant. The liquid part, which may include some oil for compressor lubrication, can then remain in the evaporator until the refrigerant is vaporized. The oil, which remains as a liquid, can be pumped back to the compressor or returned by some other means.

Examples of evaporator baffle systems are disclosed in UK Patent Application GB 2 231 133 and in U.S. Pat. Nos. 2,059,725; 2,384,413; 3,326,280 and 5,561,987. A drawback of many baffle systems is their failure to take into account a refrigerant's uneven flow velocity which may vary along the length of the evaporator shell. Uneven flow velocities are particularly prevalent when the evaporator shell has its outlet at one end of the shell rather than being centrally located. Gaseous refrigerant flowing at higher velocities may have a greater tendency to carry liquid refrigerant out of the evaporator, so uneven flow rates can be detrimental.

Consequently, a need exists for an economical flow distributor and baffle system that can evenly distribute and separate a two-phase refrigerant mixture flowing through a falling film evaporator.

SUMMARY OF THE INVENTION

It is an object of the present invention to provide an economical flow distributor and baffle system that can evenly distribute and separate a two-phase refrigerant mixture flowing through a falling film evaporator.

It is also an object of the present invention to provide a flow distributor with a stack of perforated plates, wherein at least seventy-five percent and preferably ninety percent full-width, full-length gaps exist between all the plates.

It is another object of the present invention to provide a flow distributor inlet duct whose sidewalls converge in only one direction from one end to the other.

It is also object of the present invention to provide a substantially trapezoidal inlet duct.

It is also object of the present invention to provide a substantially rectangular inlet duct.

It is a further object of the present invention to provide a flow distributor that includes an inlet duct that overlays a perforated plate, wherein the proximity of individual plate openings to the sidewalls of the duct is used to regulate the amount of liquid flow to the rest of the distributor stages.

It is a still further object of the present invention to provide a flow distributor with an internal stiffener that increases the rigidity of one or more plates of the distributor.

It is an additional object of the present invention to provide a flow distributor with downward projecting baffles that create a hairpin turn through which gaseous refrigerant must flow, whereby the sharp turn helps separate any liquid from the refrigerant.

It is another object of the present invention to add a suction baffle to a flow distributor, wherein the suction baffle has a series of openings of various sizes to control the velocity and uniformly distribute the flow of refrigerant along the length of an evaporator.

One or more of these and/or other objects of the invention are achieved by providing a falling film evaporator with a flow distributor that comprises a stack of at least three perforated plates each of which are separated by nearly full-width, full-length gaps. The flow distributor may also include a suction baffle and/or a distributor baffle, wherein the distributor baffle helps separate liquid from a gaseous refrigerant stream, and the suction baffle has various size openings to control refrigerant flow velocity and promote a more uniform flow distribution along the length of the evaporator.

BRIEF DESCRIPTIONS OF THE DRAWINGS

DESCRIPTIONS OF THE PREFERRED EMBODIMENT

Figure 1:
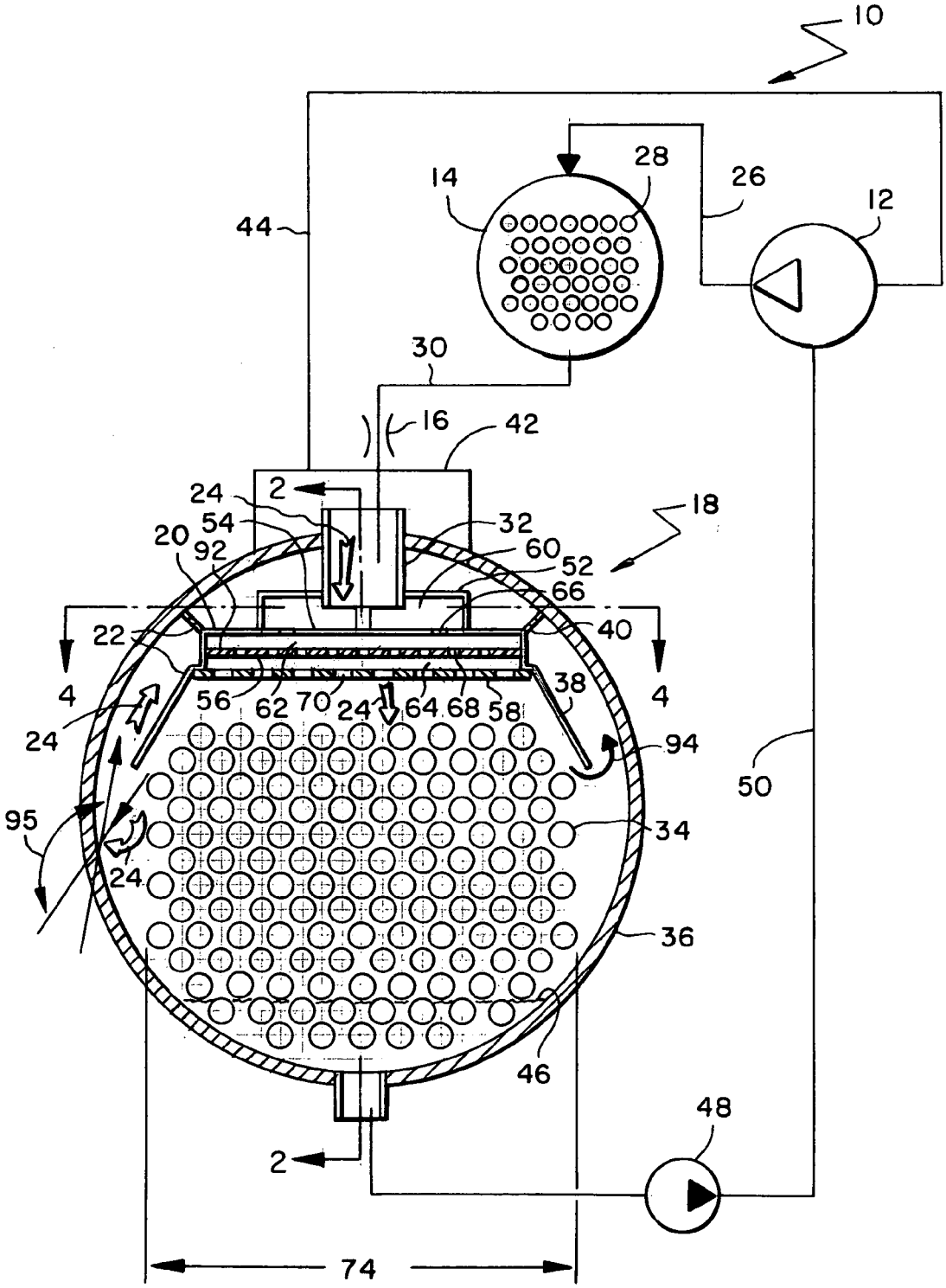
FIG. 1 is a cross-sectional end view of a falling film evaporator according to the present invention, wherein the evaporator is shown connected to a schematically illustrated refrigerant system.

FIG. 1 is a partially schematic view of a refrigerant chiller system 10 whose primary components include a compressor 12, a condenser 14, an expansion device 16 and a falling film evaporator 18. Compressor 12 can be any type of compressor including, but not limited to, a centrifugal, screw, scroll or reciprocating. Evaporator 18 includes a distributor 20 and a baffle system 22 that help determine the flow pattern of a two-phase refrigerant 24 flowing through the evaporator. The main components of chiller system 10 are interconnected to create a conventional closed-loop refrigerant circuit for providing chilled water.

In basic operation, compressor 12 discharges compressed gaseous refrigerant through a discharge line 26 to condenser 14. A cooling fluid passing through a tube bundle 28 in condenser 14 cools and condenses the refrigerant. A line 30 conveys the condensed refrigerant from condenser 14 to expansion device 16. Expansion device 16 is any flow restriction such as a orifice plate, capillary tube, expansion valve, etc. Upon passing through expansion device 16, the refrigerant cools by expansion before entering an evaporator inlet 32 as a two-phase mixture of liquid and gaseous refrigerant. Distributor 20 directs and distributes the refrigerant mixture across the top of tube bundle 34 within a shell 36 of evaporator 18. The refrigerant flows downward through the tube bundle and in passing across the exterior of the tubes of tube bundle 34 cools a heat absorbing fluid, such as water, which passes through the interior of the tubes of tube bundle 34. The chilled water can then be pumped to remote locations for various cooling purposes.

The chilled water vaporizes the liquid portion of the refrigerant mixture that passes through and across tube bundle 34. A distributor baffle 38 and a suction baffle 40, of baffle system 22, help convey preferably just the gaseous portion of the refrigerant to an evaporator outlet 42 of shell 36. From outlet 42, a suction line 44 conveys the primarily gaseous refrigerant to a suction inlet of compressor 12 so that compressor 12 can recompress the refrigerant to perpetuate the refrigerant cycle.

Any remaining liquid refrigerant within shell 36 and any oil entrained therein makes its way to and pools as a liquid 46 in the bottom of the evaporator. Such refrigerant undergoes flooded heat exchange contact with the portion tube bundle 34 that is immersed in such liquid while the oil-rich fluid located there is returned to the system compressor. A pump 48, an eductor, or some other conventional means can return liquid 46 to any appropriate inlet 50 associated with compressor 12. Inlet 50 may be a suction inlet or an intermediate compression stage of compressor 12.

Figure 2:
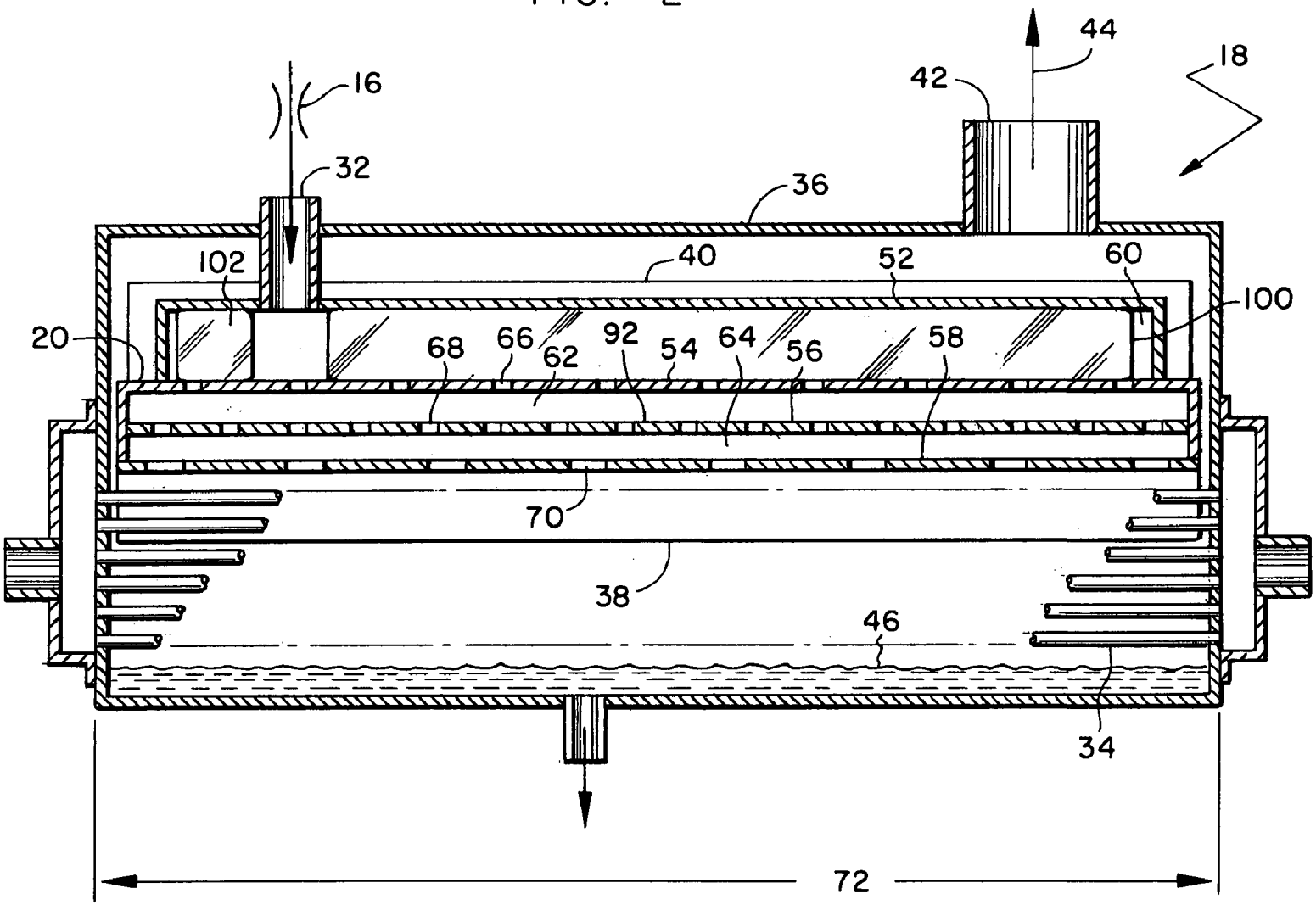
FIG. 2 is a cross-sectional front view taken along line 2—2 of FIG. 1.

Referring further to FIG. 2, to ensure even distribution of liquid refrigerant across the length and width of tube bundle 34, distributor 20 includes an inlet duct 52, an upper plate 54, an intermediate plate 56, and a lower plate 58. Inlet duct 52 is hollow, and plates 54, 56 and 58 are spaced apart to define a first chamber 60 between duct 52 and upper plate 54, a second chamber 62 between upper plate 54 and intermediate plate 56, and a third chamber 64 between intermediate plate 56 and lower plate 58. The term, "inlet duct" refers to the structure that partially surrounds and helps define first chamber 60, wherein chamber 60 is a fluid passageway.

Figure 3:
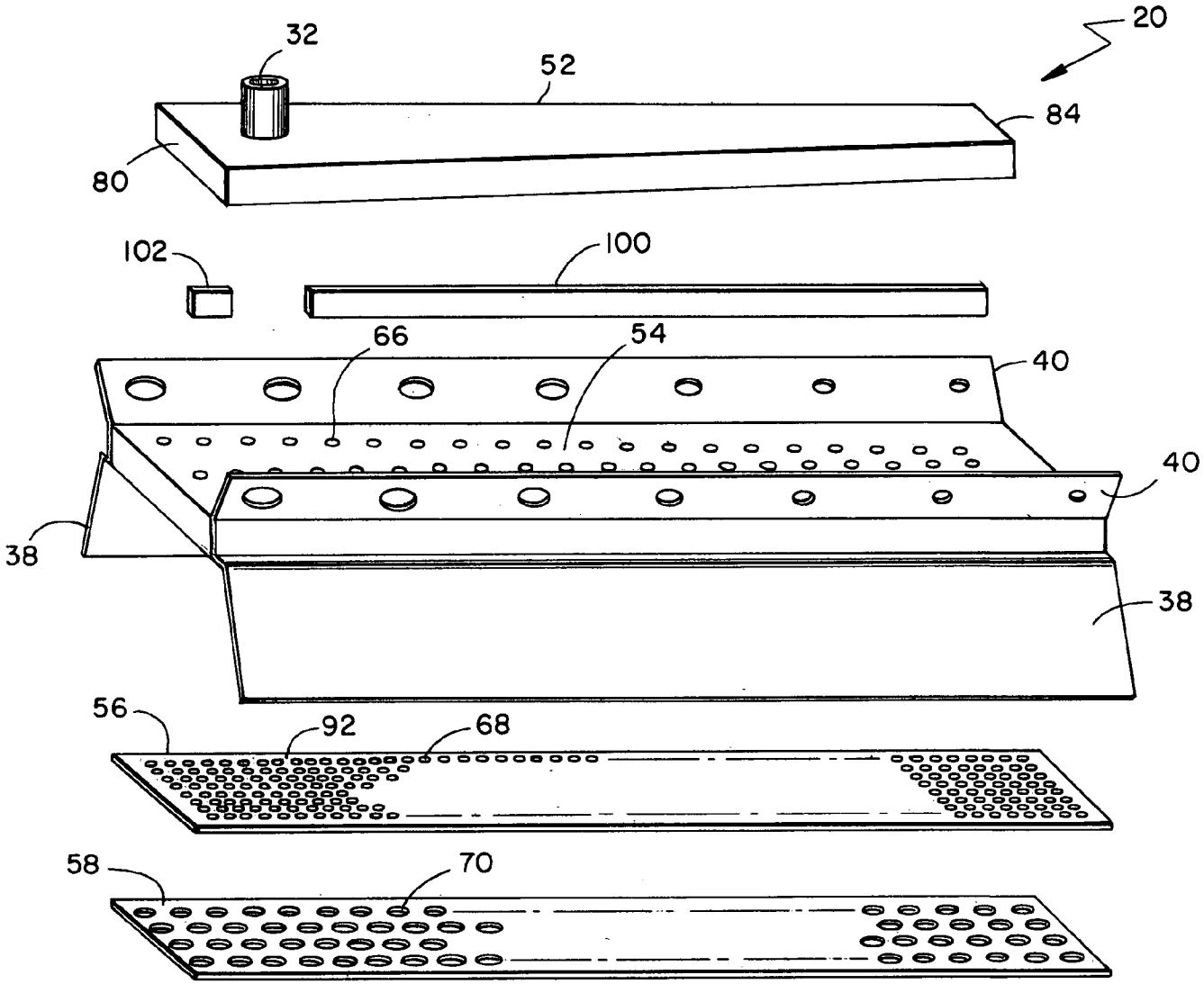
FIG. 3 is an exploded view of a flow distributor used in the evaporator of FIG. 1.

Referring further to FIG. 3, plates 54, 56 and 58 each have a set of openings so that refrigerant delivered to first chamber 60 from evaporator inlet 32 (e.g., an inlet pipe or other opening defined by shell 36) passes sequentially through a plurality of upper plate openings 66 in upper plate 54, through second chamber 64, through a plurality of intermediate plate openings 68 in intermediate plate 56, through third chamber 64, and through a plurality of lower plate openings 70 in lower plate 58. From there, liquid refrigerant is preferably deposited generally evenly across a full longitudinal length 72 and a full lateral width 74 of tube bundle 34.

Figure 4:
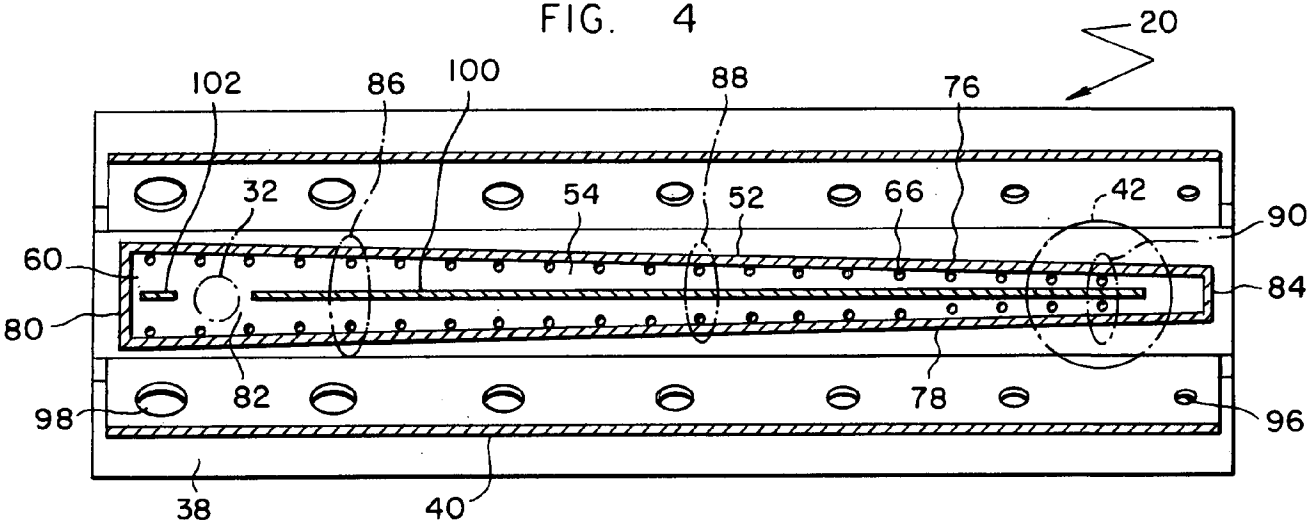
FIG. 4 is a cross-sectional top view taken along line 4—4 of FIG. 1; however, the evaporator shell has been omitted.

To achieve such even distribution of refrigerant, distributor 20 includes several important design features. Inlet duct 52, for instance, provides first chamber 60 with a preferably trapezoidal shape, creating a flow passage of reducing cross-section in the direction of flow, as shown in FIG. 4. The duct's gradually converging sidewalls 76 and 78 create a generally desirable liquid flow pattern across upper plate 54. It can be difficult, nonetheless, to uniformly distribute liquid refrigerant of a two-phase mixture because the percentage of gas and liquid varies from a lateral center 82 of chamber 60 to the edges of inlet duct 52 due to the complex nature of two-phase flow. This percentage can also vary along the length of inlet duct 52. Thus, holes 66 are strategically positioned to create uniform liquid flow out of chamber 60 along the length of the distributor. So, selecting the shape of inlet duct 52 and choosing the locations of holes 66 relative to the side walls of duct 52 provides a way of "tuning" or optimizing the refrigerant flow pattern to achieve a generally uniform distribution of liquid refrigerant across the distributor.

For equal distribution of liquid flow through each of the openings, the lateral spacing between each opening 66 and sidewalls 76 and 78 may need to vary. In other words, the distance between sidewalls 76 and 78 and the laterally spaced-apart paired openings, such as paired openings 86, 88 and 90 may vary depending on their longitudinal position along chamber 60. Paired openings 90, for example, are farther away from sidewalls 76 and 78 than are paired openings 86.

To achieve even liquid distribution both longitudinally and laterally, intermediate plate 56 has an upwardly facing surface 92 at least seventy-five or preferably ninety percent of which is exposed to refrigerant to permit substantially unobstructed horizontal flow across at least seventy-five percent of surface 92. In other words, second chamber 62 provides a gap between upper plate 54 and intermediate plate 56, wherein the gap allows generally free, unobstructed flow across the full length and width of surface 92 and therefore, across the length and width of the tube bundle. In some cases, 100% of surface 92 is unobstructed; however, a seventy-five or ninety percent value allows for one or more peripheral and/or centrally located spacers to be interposed between upper plate 54 and intermediate plate 56 for the purpose of maintaining the vertical gap between the plates.

The hole size and spacing of the openings in intermediate plate 56 and lower plate 58 further promote even flow distribution over tube bundle 34. Intermediate plate openings 68 create a greater pressure differential across intermediate plate 56 than do lower plate openings 70 create across lower plate 58. The greater flow restriction of intermediate plate 56 allows the refrigerant to "spread" itself more evenly across intermediate plate 56 before discharging through intermediate plate openings 68. The significantly lower flow resistance of lower plate 58 reduces the kinetic energy of the refrigerant and allows the discharged refrigerant to decelerate before reaching tube bundle 34 so that the liquid refrigerant in third chamber 64 generally drains onto the tube bundle. The principle under which plates 56 and 58 operate is more thoroughly explained in U.S. Pat. No. 6,167,713, incorporated herein by reference.

To help prevent gaseous refrigerant from carrying entrained liquid refrigerant and oil out through evaporator outlet 42, one or more distributor baffles 38 extend downward from distributor 20. The downward orientation creates a hairpin turn 94 around which the refrigerant travels before exiting evaporator 18. The term, "hairpin" refers to a turn having an angle (denoted by numeral 95 in FIG. 1) of more than ninety degrees and preferably more than 150 degrees. Entrained liquid droplets, being heavier than gaseous refrigerant, tend to be centrifugally slung from the sharply curved flow path of the gaseous refrigerant toward liquid pool 46.

In order for the liquid to separate from the gas, the gas velocity flow pattern around the hairpin turn 94 should be carefully designed. In that regard, the upward refrigerant flow velocity between the lower tip of edge of distributor baffle 38 and shell 36 should be maintained below a critical value to avoid carrying liquid refrigerant to the evaporator gas outlet 42 and the downward velocity of refrigerant flowing between distributor baffle 38 and tube bundle 34 should propel the liquid with sufficient momentum such that any liquid therein will reach liquid pool 46 and will not remain entrained in the upward gas flow. At the same time, the downward gas velocity should not be so great as to cause splashing in the pool that would result in additional liquid droplets becoming entrained in the gas flow stream.

A longitudinal pressure drop along the length of the lower edge of distributor baffle 38 is to be avoided as it can induce local variations in gas flow that can also cause liquid to be entrained therein in some areas along the length of the distributor baffle. To avoid this problem, one or more suction baffles 40 can be employed to help ensure that the velocity of the refrigerant traveling around the hairpin turn is generally uniform along the length of evaporator shell 36. To provide uniform flow rates along and around the edge of distributor baffle 38, suction baffle 40 may have suction baffle openings that are smaller near evaporator outlet 42. Baffle opening 96, for example, is smaller than baffle opening 98. Although the baffle openings are shown to be round, rectangular and various other shapes are also well within the scope of the invention.

Figure 5:
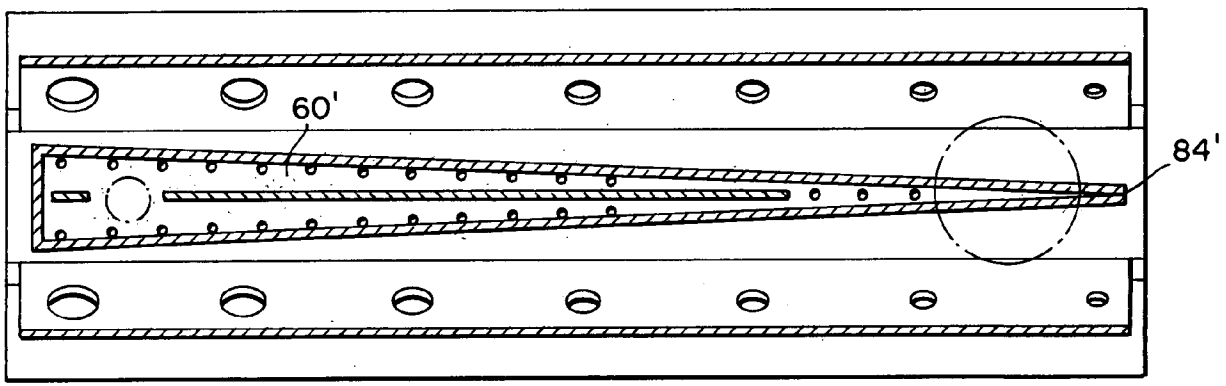
FIG. 5 is a cross-sectional top view similar to FIG. 4 but of another embodiment.

Features that make distributor 20 more structurally sound and easier to manufacture include inlet duct 52 being tapered in only one direction from a wider end 80 of duct 52 to a narrower end 84, duct 52 being generally blunt at end 84, and internal stiffeners 100 and 102 being interposed between duct 52 and upper plate 54. Inlet duct 52 being tapered in only one direction allows the duct to be fabricated as a single piece. End 84 being blunt rather than pointed also makes inlet duct 52 easier to manufacture. It should be noted, however, that end 84' being pointed to create a generally triangular chamber 60' (FIG. 5), or chamber 60 being rectangular are other embodiments that are well within the scope of the invention. Stiffeners 100 and 102 can be bars welded to inlet duct 52 and upper plate 54 to increase their rigidity. Installing stiffeners 100 and 102 internally within first chamber 60 ensures that the stiffeners do no interfere with any other components of evaporator 18 or obstruct the flow of suction gas to the evaporator outlet 42.

Although the invention is described with reference to a preferred embodiment, it should be appreciated by those skilled in the art that other variations are well within the scope of the invention. Therefore, the scope of the invention is to be determined by reference to the following claims:

What is claimed is:

1. A falling film evaporator through which a refrigerant is conveyed, the falling film evaporator comprising:

a shell defining an evaporator inlet and an evaporator outlet, the shell having a longitudinal length and a lateral width;

a tube bundle inside the shell; and a distributor disposed above the tube bundle and being in fluid communication with the evaporator inlet and the evaporator outlet, the distributor including an inlet duct, an upper plate underneath the inlet duct, an intermediate plate underneath the upper plate and a lower plate underneath the intermediate plate, the inlet duct and the upper plate defining a first chamber therebetween that is in fluid communication with the evaporator inlet, the upper plate and the intermediate plate defining a second chamber therebetween, the intermediate plate and the lower plate defining a third chamber therebetween, the upper plate further defining a plurality of upper plate openings that place the first chamber in fluid communication with the second chamber, the intermediate plate further defining a plurality of intermediate plate openings that place the second chamber in fluid communication with the third chamber and the lower plate defining a plurality of lower plate openings so that the refrigerant from the evaporator inlet flows sequentially through the first chamber, through the plurality of upper plate openings, through the second chamber, through the plurality of intermediate plate openings, through the third chamber, through the plurality of lower plate openings, and then onto the tube bundle, the intermediate plate having an upwardly facing surface at least seventy-five percent of which is exposed to the refrigerant to permit substantially unobstructed horizontal flow across at least seventy-five percent of the upwardly facing surface.

2. The falling film evaporator of claim 1, wherein substantially all of the upwardly facing surface of the intermediate plate of the distributor is exposed to the refrigerant to permit substantially unobstructed horizontal flow across substantially the entire upwardly facing surface.

3. The falling film evaporator of claim 1, wherein a horizontal cross-section of the first chamber of the distributor has a substantially triangular shape.

4. The falling film evaporator of claim 1, wherein a horizontal cross-section of the first chamber of the distributor has a substantially trapezoidal shape.

5. The falling film evaporator of claim 1, wherein a horizontal cross-section of the first chamber of the distributor has a substantially rectangular shape.

6. The falling film evaporator of claim 1, wherein the plurality of upper plate openings comprise a series of laterally spaced-apart paired openings and wherein some of the laterally spaced-apart paired openings are laterally closer to an outer periphery of the first chamber than are other laterally spaced-apart paired openings.

7. The falling film evaporator of claim 1, further comprising a stiffener disposed within the first chamber and being attached to the inlet duct and the upper plate.

8. The falling film evaporator of claim 7, wherein the stiffener is centrally disposed within the first chamber.

9. The falling film evaporator of claim 1, further comprising a distributor baffle extending downward from the distributor to create a turn of greater than ninety degrees that refrigerant follows in traveling from the distributor to the evaporator outlet.

10. The falling film evaporator of claim 9, wherein the distributor baffle is spaced apart from the shell.

11. The falling film evaporator of claim 1, further comprising a suction baffle extending from the distributor toward the shell and defining a plurality of suction baffle openings through which refrigerant passes in traveling from the distributor to the evaporator outlet, the plurality of suction baffle openings being of various sizes.

12. The falling film evaporator of claim 11, wherein the plurality of suction openings include larger openings and smaller openings, wherein the smaller openings are closer to the evaporator outlet than are the larger openings.

13. A falling film evaporator through which a refrigerant is conveyed, the falling film evaporator comprising:

a shell defining an evaporator inlet and an evaporator outlet, the shell having a longitudinal length and a lateral width;

a tube bundle inside the shell;

a distributor disposed above the tube bundle and receiving two-phase refrigerant from the evaporator inlet, the distributor including an inlet duct, an upper plate underneath the inlet duct, a lower plate underneath the upper plate, the inlet duct and the upper plate defining a first chamber therebetween that is in fluid communication with the evaporator inlet, the upper plate and the lower plate defining a second chamber therebetween, the upper plate defining a plurality of upper plate openings that place the first chamber in fluid communication with the second chamber, the lower plate defining a plurality of lower plate openings such that the refrigerant from the evaporator inlet flows sequentially down through the first chamber, through the plurality of upper plate openings, through the second chamber, through the plurality of lower plate openings, and then down to the tube bundle; and a distributor baffle, said distributor baffle extending downward from the distributor to create a turn of greater than ninety degrees that refrigerant follows in traveling from the distributor to the evaporator outlet.

14. The falling film evaporator of claim 13, wherein the distributor baffle is spaced apart from the shell.

15. The falling film evaporator of claim 13, further comprising a suction baffle extending from the distributor toward the shell and defining a plurality of suction baffle openings through which the refrigerant passes in traveling from the distributor to the evaporator outlet, the plurality of suction baffle openings being of more than one size.

16. The falling film evaporator of claim 15, wherein the plurality of suction openings include larger openings and smaller openings, the smaller openings being closer to the evaporator outlet than are the larger openings.

17. A falling film evaporator through which a refrigerant is conveyed, the falling film evaporator comprising:

a shell defining an evaporator inlet and an evaporator outlet, the shell having a longitudinal length and a lateral width;

a tube bundle inside the shell; and a two-phase refrigerant distributor disposed above the tube bundle and being in fluid communication with the evaporator inlet and the evaporator outlet, the distributor including an inlet duct, an upper plate underneath the inlet duct, a lower plate underneath the upper plate, the inlet duct and the upper plate defining a first chamber therebetween that is in fluid communication with the evaporator inlet, the upper plate and the lower plate defining a second chamber therebetween, the upper plate defining a plurality of upper plate openings that place the first chamber in fluid communication with the second chamber, the lower plate defining a plurality of lower plate openings such that the refrigerant from the evaporator inlet flows sequentially through the first chamber, through the plurality of upper plate openings, through the second chamber, through the plurality of lower plate openings, and then down to the tube bundle; and a suction baffle, said suction baffle being interposed between the distributor and the shell and defining a plurality of suction baffle openings through which refrigerant passes in traveling from the distributor to the evaporator outlet, the plurality of suction baffle openings being of more than one size.

18. The falling film evaporator of claim 17, wherein the plurality of suction openings include larger openings and smaller openings, wherein the smaller openings are closer to the evaporator outlet than are the larger openings.

19. The falling film evaporator of claim 17, further comprising a baffle which extends downward from the distributor to create a turn of greater than ninety degrees that refrigerant follows in traveling from the distributor to the evaporator outlet.

20. The falling film evaporator of claim 19, wherein the distributor baffle is spaced apart from the shell.

21. A falling film evaporator through which a refrigerant is conveyed, the falling film evaporator comprising:

a shell defining an evaporator inlet and an evaporator outlet, the shell having a longitudinal length and a lateral width;

a tube bundle inside the shell; and a two-phase refrigerant distributor disposed above the tube bundle and being in fluid communication with the evaporator inlet and the evaporator outlet, the distributor including an inlet duct, an upper plate underneath the inlet duct, a lower plate underneath the upper plate, the inlet duct and the upper plate defining a first chamber therebetween that is in fluid communication with the evaporator inlet and is trapezoidal in horizontal cross-section, the upper plate and the lower plate defining a second chamber therebetween, the upper plate further defining a plurality of upper plate openings that place the first chamber in fluid communication with the second chamber and the lower plate further defining a plurality of lower plate openings, refrigerant flowing from the evaporator inlet sequentially through the first chamber, through the plurality of upper plate openings, through the second chamber, through the plurality of lower plate openings, and then to the tube bundle.

22. A falling film evaporator through which a refrigerant is conveyed, the falling film evaporator comprising:

a shell defining an evaporator inlet and an evaporator outlet, the shell having a longitudinal length and a lateral width;

a tube bundle inside the shell; and a two-phase refrigerant distributor disposed above the tube bundle and being in fluid communication with the evaporator inlet and the evaporator outlet, the distributor including an inlet duct, an upper plate underneath the inlet duct, a lower plate underneath the upper plate, the inlet duct and the upper plate defining a first chamber therebetween that is in fluid communication with the evaporator inlet and is triangular in horizontal cross-section, the upper plate and the lower plate defining a second chamber therebetween, the upper plate defining a plurality of upper plate openings that place the first chamber in fluid communication with the second chamber and the lower plate defining a plurality of lower plate openings such that the refrigerant from the evaporator inlet flows sequentially through the first chamber, through the plurality of upper plate openings, through the second chamber, through the plurality of lower plate openings, and then to the tube bundle.

23. A method of conveying a two-phase mixture of a liquid refrigerant and a gaseous refrigerant through the shell of a falling film evaporator, wherein the shell defines and evaporator inlet and an evaporator outlet and contains a tube bundle, the method comprising the steps of:

conveying the two-phase mixture to a first chamber within the shell;

conveying the two-phase mixture from the first chamber to a second chamber that is below the first chamber, the second chamber having a substantially rectangular perimeter;

permitting substantially unobstructed horizontal flow within the substantially perimeter of the second chamber;

conveying the two-phase mixture from the second chamber to a third chamber that is below the second chamber;

conveying the two-phase mixture from the third chamber to the tube bundle, the bundle vaporizing at least some of the liquid refrigerant to increase the amount of the gaseous refrigerant within the shell; and conveying the gaseous refrigerant from the tube bundle to the evaporator outlet.

24. A method of conveying a two-phase mixture of a liquid refrigerant and a gaseous refrigerant through the shell of a falling film evaporator, wherein the shell defines an evaporator inlet and an evaporator outlet and contains a tube bundle, the method comprising the steps of:

conveying the two-phase mixture to a first chamber within the shell;

conveying the two-phase mixture from the first chamber to a second chamber that is below the first chamber;

conveying the two-phase mixture from the second chamber to the tube bundle, so as to vaporize at least some of the liquid refrigerant to increase the amount of the gaseous refrigerant; and conveying the gaseous refrigerant through a plurality of suction baffle openings of various sizes to the evaporator outlet.

25. The method of claim 24, wherein the plurality of suction baffle openings include larger holes and smaller holes, and further comprising the step of placing the evaporator outlet closer to the smaller holes than to the larger holes.

26. A falling film evaporator comprising:

a shell, said shell defining a refrigerant inlet and a refrigerant outlet;

a tube bundle;

a two-phase refrigerant distributor disposed above said tube bundle in said shell and being in flow communication with said shell inlet, said two-phase refrigerant distributor having a distributor baffle and a suction baffle and receiving two-phase refrigerant from said shell inlet, said two-phase refrigerant distributor defining first, second and third chambers through which two-phase refrigerant flows prior to exiting said distributor, said first chamber causing two-phase refrigerant to flow along the length of the distributor, said second chamber causing two-phase refrigerant to be distributed across the width of said distributor and said third chamber reducing the velocity and kinetic energy of said two-phase refrigerant, said distributor baffle extending downward from the distributor external of the sides of said tube bundle and causing refrigerant which first flows downward from the distributor to the tube bundle to follow a flow path to said shell outlet which includes a turn of greater than 90°, said suction baffle being disposed in the refrigerant flow path intermediate said turn and said shell outlet and defining a plurality of apertures, said plurality of apertures sized so as to maintain the velocity of refrigerant vapor through said turn and along the length of said distributor baffle below a predetermined velocity.

* * * * *